US007629733B2

(12) United States Patent
Ishimoto et al.

(10) Patent No.: US 7,629,733 B2
(45) Date of Patent: Dec. 8, 2009

(54) DISPLAY DEVICE HAVING PLURALITY OF CURVED GAS DISCHARGE TUBES

(75) Inventors: Manabu Ishimoto, Kobe (JP); Yosuke Yamazaki, Kobe (JP); Hitoshi Yamada, Kawasaki (JP); Hitoshi Hirakawa, Kobe (JP); Akira Tokai, Kawasaki (JP); Koji Shinohe, Kobe (JP); Kenji Awamoto, Kobe (JP)

(73) Assignee: Shinoda Plasma Co., Ltd., Kobe (JP)

( * ) Notice: Subject to any disclaimer, the term of this patent is extended or adjusted under 35 U.S.C. 154(b) by 247 days.

(21) Appl. No.: 11/892,654

(22) Filed: Aug. 24, 2007

(65) Prior Publication Data

US 2008/0048546 A1 Feb. 28, 2008

Related U.S. Application Data

(63) Continuation of application No. PCT/JP2005/003050, filed on Feb. 24, 2005.

(51) Int. Cl.
*H01J 1/62* (2006.01)
*H01J 17/16* (2006.01)

(52) U.S. Cl. ..... 313/493; 313/485; 313/634

(58) Field of Classification Search ..... 313/493, 313/634, 573, 485

See application file for complete search history.

(56) References Cited

U.S. PATENT DOCUMENTS

| | | | | |
|---|---|---|---|---|
| 6,633,117 | B2 * | 10/2003 | Shinoda et al. | 313/484 |
| 6,650,055 | B2 * | 11/2003 | Ishimoto et al. | 313/623 |
| 6,836,063 | B2 * | 12/2004 | Ishimoto et al. | 313/484 |
| 2001/0028216 | A1 | 10/2001 | Tokai et al. | |
| 2003/0052592 | A1 | 3/2003 | Shinoda et al. | |

FOREIGN PATENT DOCUMENTS

| | | |
|---|---|---|
| JP | 51-40755 | 4/1976 |
| JP | 2000-035514 | 2/2000 |
| JP | 2001-265256 | 9/2001 |
| JP | 3082868 | 10/2001 |
| JP | 2003-92085 | 3/2003 |
| JP | 2004-134191 | 4/2004 |

OTHER PUBLICATIONS

International Search Report of International Published Application No. PCT/JP2005/003050 (mailed Apr. 5, 2005).
PCT Published Application No. WO 2006/059379, Published Aug. 31, 2006 (International Application No. PCT/JP2005/003050).

* cited by examiner

*Primary Examiner*—Karabi Guharay
(74) *Attorney, Agent, or Firm*—Staas & Halsey LLP

(57) ABSTRACT

A display device (12) has a display screen, the display screen comprising a plurality of gas discharge tubes (20R, 20G, 20B, . . . 28R, 28G, 28B) disposed side by side. Each of the gas discharge tubes includes a phosphor layer (4) formed therein and also includes a discharge gas contained therein. Each gas discharge tube has a plurality of light-emitting points. Each of the plurality of gas discharge tubes (20R, 20G, 20B, . . . 28R, 28G, 28B) is curved along the longitudinal direction thereof. The display screen is formed by combining the plurality of gas discharge tubes having different magnitudes of curvature.

4 Claims, 6 Drawing Sheets

DISPLAY DEVICE HAVING PLURALITY OF CURVED GAS DISCHARGE TUBES

This application is a continuation application of international application PCT/JP2005/003050 filed Feb. 24, 2005.

FIELD OF THE INVENTION

The present invention relates generally to a display device, and more particularly to a display device including a number of gas discharge tubes.

BACKGROUND ART

Japanese Patent Application Publication JP 2003-92085-A (corresponding to US 2003/052592-A1) published on Mar. 28, 2003 by SHINODA et al. discloses, especially in its FIG. 18, arranging display tubes along an inner surface or curved surface of a cylindrical support wall to surround a viewer so as to realize such a display that the viewer can be absorbed in the scene being displayed or can feel as if the viewer were in the scene being displayed.

DISCLOSURE OF THE INVENTION

The display device according to the publication JP 2003-92085-A cannot display an image on the ceiling above the viewer, and hence cannot give the viewer a sense of presence.

The inventors have recognized that a display capable of enhancing the viewer's sense of presence and enabling the viewer to be absorbed more in the displayed scene can be realized by providing a display surrounding the viewer not only in the horizontal direction but also in the vertical direction, in other words, providing a display covering also the area above the viewer.

An object of the present invention is to provide a display device including a plurality of gas discharge tubes arranged with substantially the same spacing substantially without gaps between adjacent tubes.

Another object of the invention is to provide a display device having a display screen curving to cover the entire field of vision of a viewer.

SUMMARY OF THE INVENTION

In accordance with an aspect of the present invention, a display device has a display screen comprising a plurality of gas discharge tubes disposed side by side. Each of the gas discharge tubes includes a phosphor layer formed therein and also includes a discharge gas contained therein. Each gas discharge tube has a plurality of light-emitting points. Each of the plurality of gas discharge tubes is curved along the longitudinal direction thereof. The display screen is formed by combining the plurality of gas discharge tubes having different magnitudes of curvature.

In accordance with another aspect of the invention, a display device has a display screen comprising a plurality of gas discharge tubes disposed side by side. Each of the gas discharge tubes includes a phosphor layer formed therein and also includes a discharge gas contained therein. Each gas discharge tube has a plurality of light-emitting points. Each of the plurality of gas discharge tubes is curved along the longitudinal direction thereof. The plurality of gas discharge tubes are disposed side by side in such a manner that the magnitude of curvature of said display screen decreases from one side to the other.

According to the invention, a display device including a plurality of gas discharge tubes arranged with substantially the same spacing substantially without gaps between adjacent tubes can be provided, and a display device having a display screen curving to cover the entire field of vision of a viewer can be provided.

DESCRIPTION OF THE PREFERRED EMBODIMENTS

The invention will be described with reference to the accompanying drawings. Throughout the drawings, similar symbols and numerals indicate similar items and functions.

Figure 1:
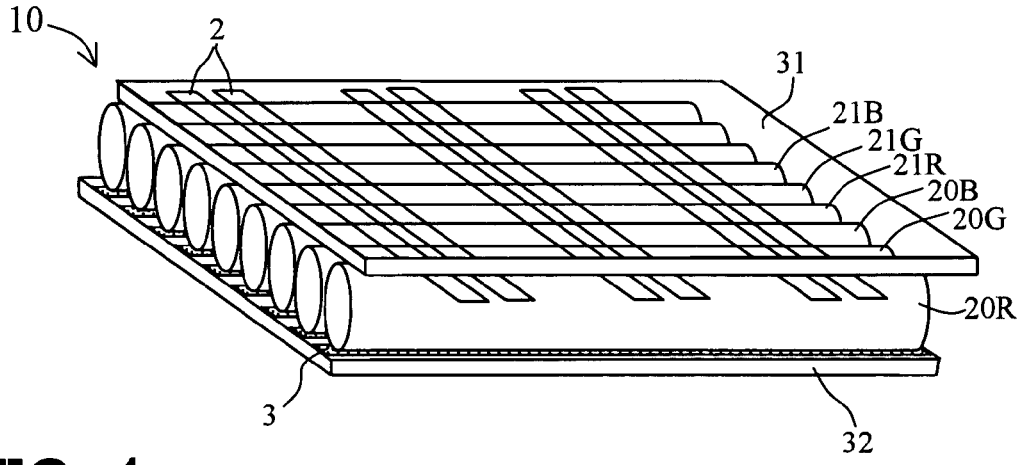
FIG. 1 shows an example of the structure of part of a display device in accordance with an embodiment of the present invention.

FIG. 1 shows an example of the structure of part of a display device 10 in accordance with an embodiment of the present invention. In FIG. 1, the display device 10 includes transparent thin gas discharge tubes 20R, 20G, 20B, 21R, 21G, 21B, . . . , disposed side by side at substantially regular intervals with substantially no gap between the adjacent tubes, a transparent, front support sheet or thin plate 31, a rear support sheet or thin plate 32, pairs of electrodes for display 2, and signal electrodes or data electrodes 3.

Typically, phosphor support members having respective red, green and blue (R, G, B) phosphor layers formed or deposited thereon are inserted into the interiors (i.e., discharge spaces) of the thin gas discharge tubes 20R, 20G, 20B, 21R, 21G, 21B, . . . , respectively. Discharge gas is introduced into the interior of each gas discharge tube, and the gas discharge tube is sealed at its opposite ends. Alternatively, the phosphor layer may be formed or deposited on the inner surface of an associated gas discharge tube without using the support member. The signal electrodes 3 are formed on the rear support sheet 32 and extend along the longitudinal direction of the respective discharge tubes 20R, 20G, 20B, . . . . The pairs of display electrodes 2 are formed on the front support sheet 31 and extend in the direction crossing the signal electrodes 3. A distance providing a non-discharging region or non-discharging gap is provided between each pair of display electrodes 2 and an adjacent pair of display electrodes 2.

The signal electrodes 3 and the pairs of display electrodes 2 are brought into intimately contact respectively with the lower and upper peripheral surfaces of the gas discharge tubes 20R, 20G, 20B, . . . , when the display device 10 is assembled. In order to provide better contact, a conductive adhesive may be placed between the display electrodes and the gas discharge tubes.

In plan view of the display device 10 seen from the front side, the intersections of the signal electrodes 3 and the pairs of display electrodes 2 provide unit light-emitting regions. Display is provided by using either one electrode of each pair of display electrodes 2 as a scanning electrode, generating a selection discharge at the intersection of the scanning electrode with the signal electrode 3 to thereby select a light-emitting region, and generating a display discharge between the pair of display electrodes 2 using the wall charge formed by the selection discharge on the region of the inner tube surface at the selected region, which, in turn, causes the associated phosphor layer to emit light. The selection discharge is an opposed discharge generated within each gas discharge tube 1 between the vertically opposing scan electrode and the signal electrode 3. The display discharge is a surface discharge generated within each gas discharge tube 1 between the two display electrodes of each pair of display electrodes disposed in parallel in a plane.

With the above-described arrangement of the display device 10 with a number of such gas discharge tubes 20R, 20G, 20B, . . . , arranged side by side, the display electrodes and the signal electrodes may be formed beforehand in the shape of dot and stripe, respectively, on the outer surfaces of the gas discharge tubes 20R, 20G, 20B, . . . , by printing, vapor deposition or any appropriate techniques, and power supply electrodes are formed on the front support sheet 31 and rear support sheet 32. When the display device 10 is assembled, the power supply electrodes are brought into contact with the display electrodes 2 and the signal electrodes 3 of the gas discharge tubes 20R, 20G, 20B, . . . .

Figure 2:
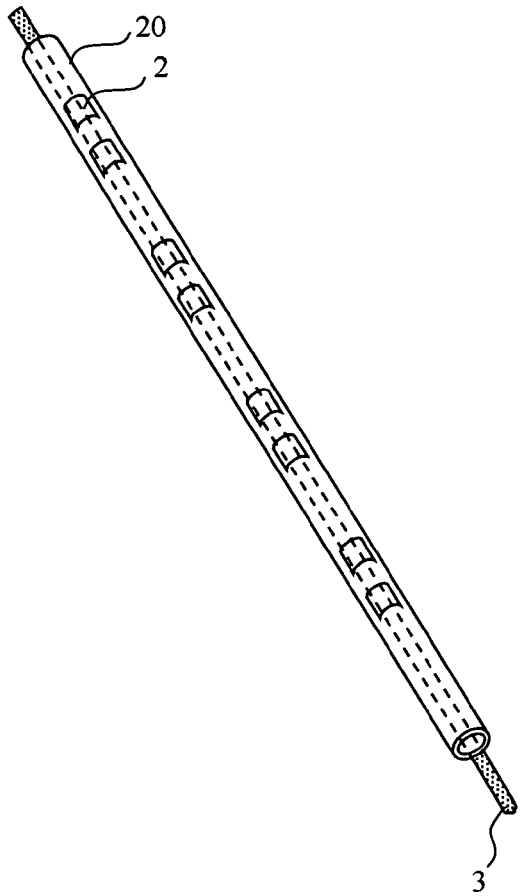
FIG. 2 shows an example of a gas discharge tube with pairs of dot-shaped display electrodes and a stripe-shaped signal electrode, which are formed on the tube surface.

FIG. 2 shows an example of a gas discharge tube 20 with pairs of dot-shaped display electrodes 2 and a stripe-shaped signal electrode 3, which are formed on the tube surface.

Figure 3A:
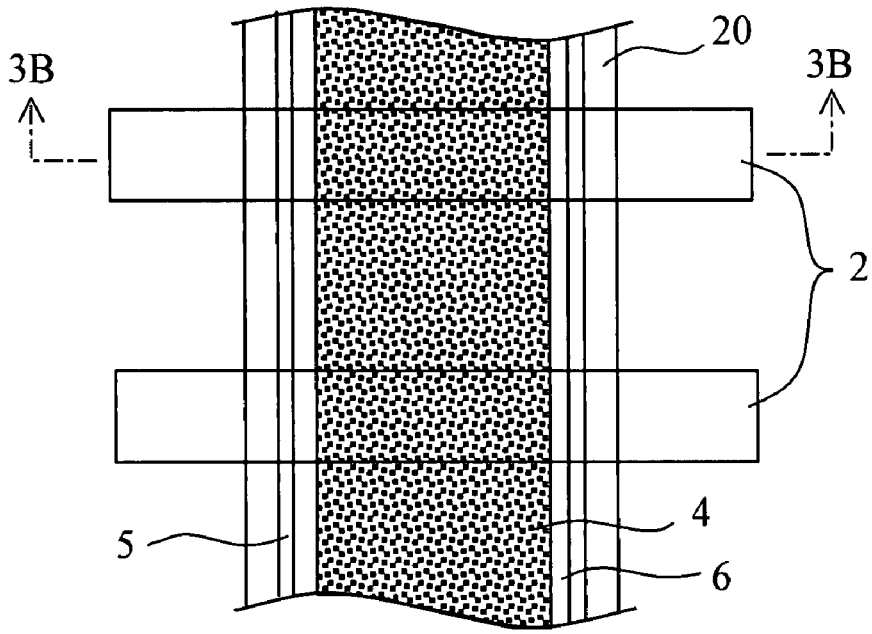
FIG. 3A is a partial enlarged plan view of the gas discharge tube in the vicinity of the pair of display electrodes.
Figure 3B:
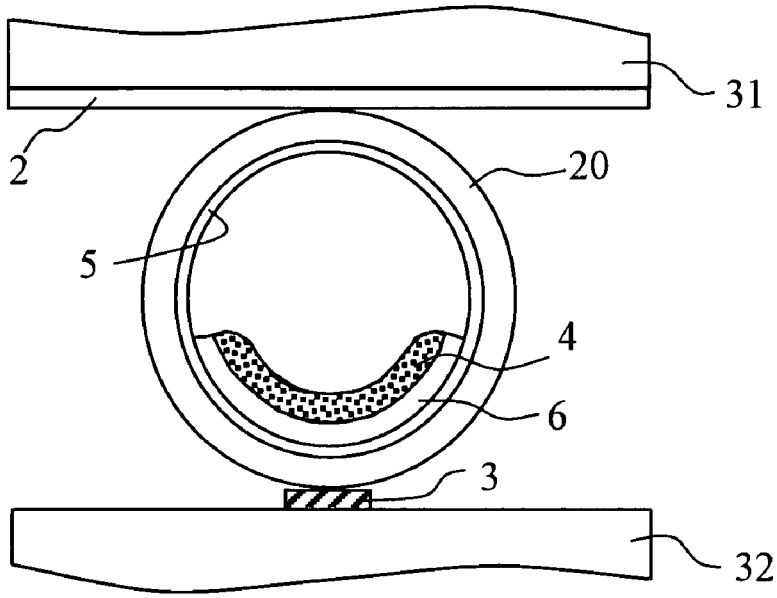
FIG. 3B is a cross-sectional view of the gas discharge tube along a line 3B-3B in FIG. 3A.

FIG. 3A is a partial enlarged plan view of the gas discharge tube 20 in the vicinity of the pair of display electrodes 2. FIG. 3B is a cross-sectional view of the gas discharge tube 20 along a line 3B-3B in FIG. 3A. An electron emissive film 5 of MgO is formed on the inner surface of the gas discharge tube 20, and a support member 6 with a phosphor layer 4 formed thereon is disposed within the gas discharge tube 20.

As described above, the gas discharge tube 20 is arranged such that the phosphor layer 4 is caused to emit light through discharge by the plurality of pairs of display electrodes disposed in contact with the tube outer wall surface, whereby a number of light-emitting points (display portions) can be provided in the single tube. The gas discharge tube 20 is formed of a transparent insulating material, e.g. borosilicate glass, and, typically, has a tube diameter of 2 mm or smaller and a tube length of 300 mm or larger.

The support member 6 is formed of a transparent insulating material, e.g. borosilicate glass, and is a member separate from the tubular envelope (glass tube) of the gas discharge tube 20. The support member 6 may be disposed within the glass tube by applying a paste of phosphor over the support member 6 outside the glass tube and then baking the phosphor paste to form the phosphor layer 4 on the support member 6, before inserting the support member 6 into the glass tube. As the phosphor paste, a desired one of various phosphor pastes known in this technical field may be employed.

The pair of display electrodes 2 and the signal electrode 3 can generate discharges in the discharge gas within the tube by applying voltages between them. The electrode structure of the gas discharge tube 20 shown in FIGS. 3A and 3B is such that the three electrodes are disposed in one light-emitting region, and that the discharge between the pair of display electrodes generates a discharge for display. However, the electrode structure is not limited to such a structure. A display discharge may be generated between the display electrode 2 and the signal electrode 3. In other words, an electrode structure of a type employing a single display electrode may be employed instead of each pair of display electrodes 2, in which the single display electrode 2 is used as a scanning electrode so that a selection discharge and a display discharge (opposed discharge) are generated between the single display electrode 2 and the signal electrode 3.

The electron emissive film 5 emits charged particles, when it is bombarded with the discharge gas having energy above a given value. When a voltage is applied between the pair of display electrodes 2, the discharge gas contained in the tube is excited. The phosphor layer 4 emits visible light by converting thereinto vacuum ultraviolet radiation generated in the de-excitation process of the excited rare gas atoms.

Figure 4:
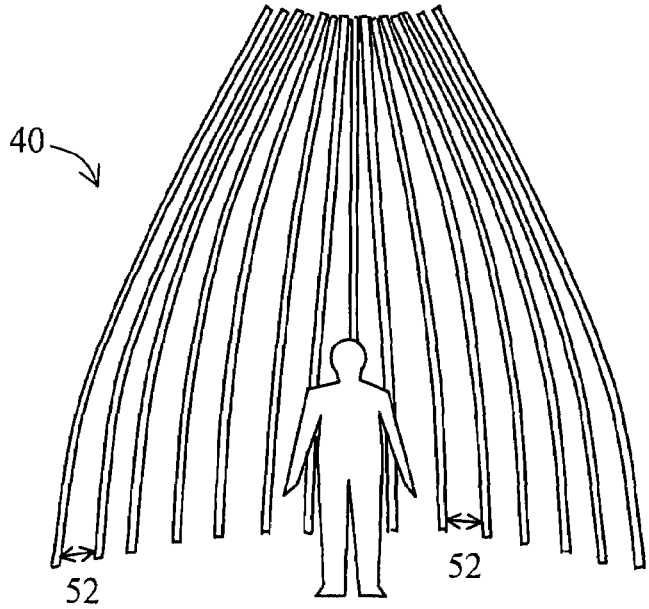
FIG. 4 shows a display device which is shaped to cover the entire field of vision the viewer.

FIG. 4 shows a display device resulting from modifying the display device (302) disclosed in the publication JP 2003-92085-A into a shape to cover the entire field of view or vision of the viewer. When the display device 302 is arranged to cover the area above the viewer, a number of undesirable gaps 52 each having a width larger than the diameter of the elongated gas discharge tubes are formed between adjacent ones of the gas discharge tubes in the region around the lateral sides of the viewer, which is an obstacle to provision of high-quality image display.

Figure 5:
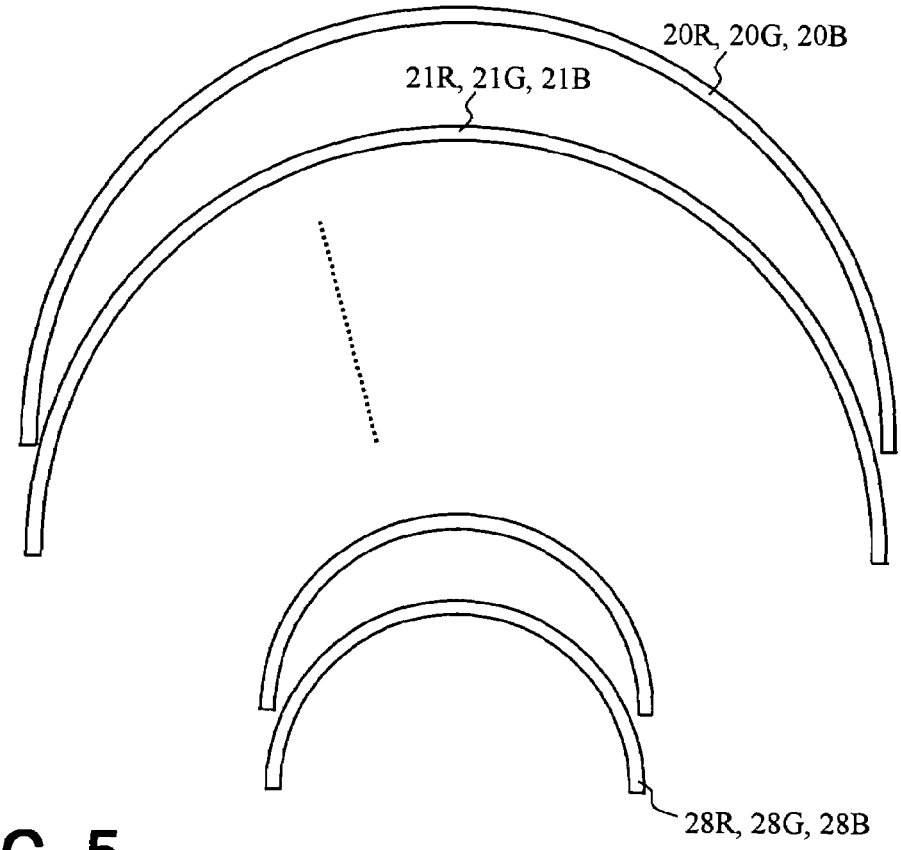
FIG. 5 shows a plurality of sets of curved gas discharge tubes in accordance with an embodiment of the invention.

FIG. 5 shows a plurality of sets of curved gas discharge tubes (20R, 20G, 20B), (21R, 21G, 21B), . . . , (28R, 28G, 28B) in accordance with an embodiment of the invention. Each set of gas discharge tubes includes three gas discharge tubes emitting light of R, G and B, respectively. The three gas discharge tubes in each set (20R, 20G, 20B), (21R, 21G, 21B), . . . , or (28R, 28G, 28B) have the same length and the same shape, and have their respective opposite end portions curved toward the front side for display or the viewer. Preferably, the three gas discharge tubes in each set are curved to have the same radius and the same curvature. The curving shape of each gas discharge tube may be generally semicircular, or generally circular, or it may be of a shape of arc extending over an angle other than 180 degrees, e.g. 90 degrees or 120 degrees. Alternatively, it may have a shape of ellipse or of part of ellipse. The different sets of gas discharge tubes (20R, 20G, 20B), (21R, 21G, 21B), . . . , and (28R, 28G, 28B) have their lengths and radii substantially monotonically decreasing in this named order, and hence have monotonically increasing the curvature in this named order.

The glass thin tubes used herein are sufficiently thin to be bent with the curvature radius of one meter without breaking. Thus, the curved discharge tube 1 may be formed by first forming a phosphor layer and an electron emissive film on the inner surface of a thin tube and then curving it, taking advantage of the toughness of the glass tube. Alternatively, it may be fabricated by heating and curving the thin tube and then forming the phosphor layer and the electron emissive film on the inner surface thereof. Alternatively, it may be fabricated by heating and curving the thin tube and the support member with an accurately fixed curvature, then forming the electron emissive film on the inner surface of the thin tube and the phosphor layer on the support member, and thereafter inserting the curved support member into the curved thin tube. Alternatively, a straight discharge tube with the electron emissive film and phosphor layer formed therein may be heated and gradually curved. Alternatively, a straight discharge tube, on the inner surface of which the electron emissive film is formed and into which a straight support member with the phosphor layer formed thereon is inserted may be heated and gradually curved.

Figure 6A:
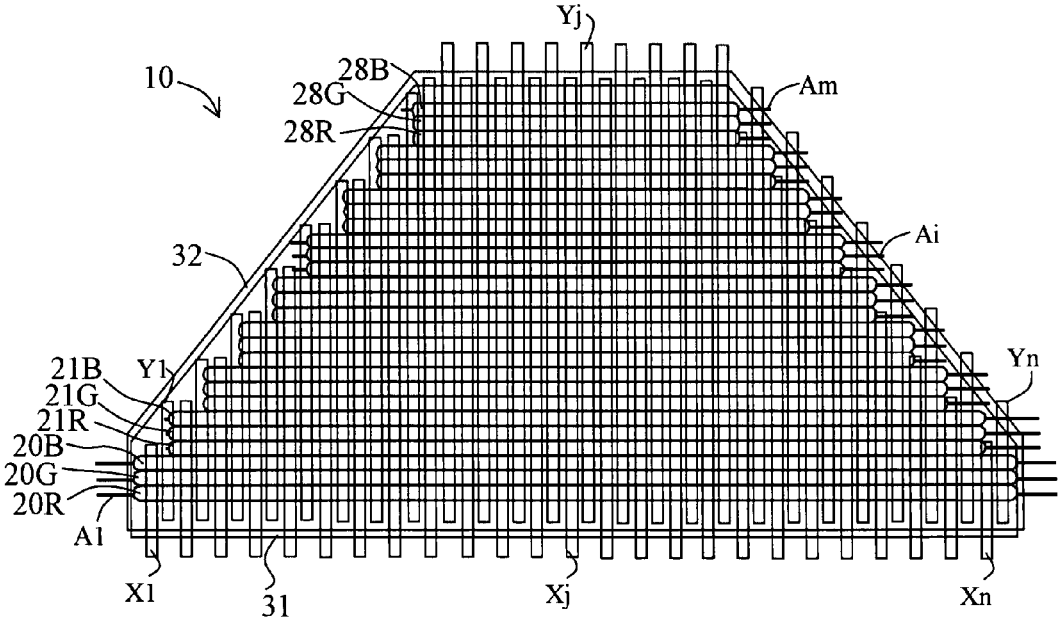
FIGS. 6A and 6B are front and rear views, respectively, of a display device assembled by arranging a plurality of elongated gas discharge tubes of FIG. 5 to be used in the display device of the invention, in which the gas discharge tubes are disposed adjacent to each other at generally regular intervals with substantially no spacing between adjacent tubes.
Figure 6B:
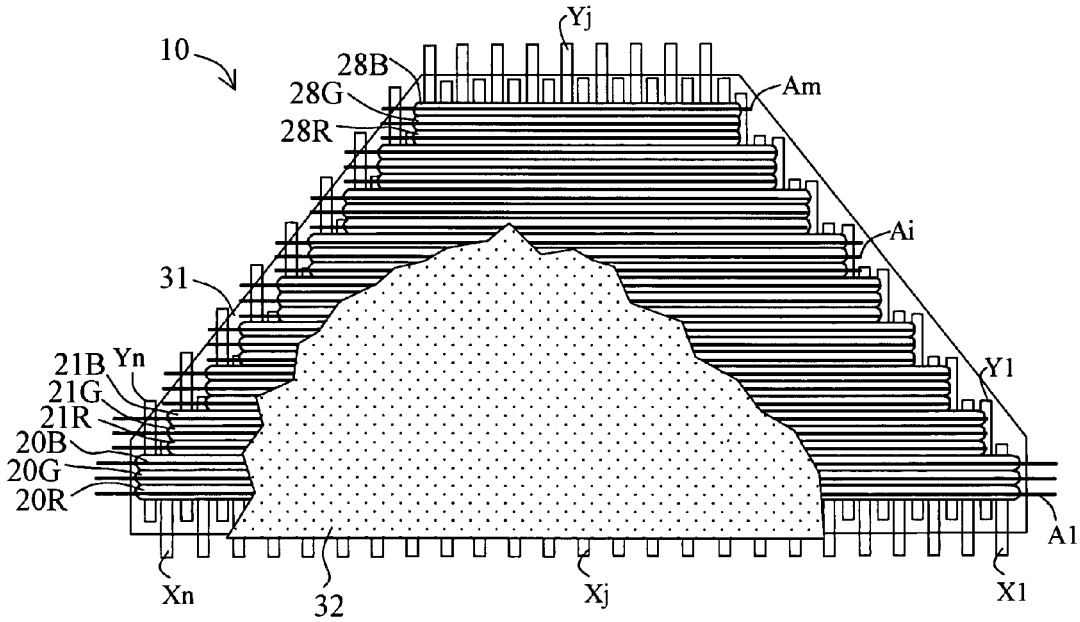

FIGS. 6A and 6B are front and rear views, respectively, of a display device 10 assembled by arranging a plurality of elongated gas discharge tubes 20R, 20G, 20B, 21R, 21G, 21B, . . . , 28R, 28G, and 28B shown in FIG. 5 to be used in the display device 10 of the invention, in which the gas discharge tubes are disposed adjacent to each other at generally regular intervals with substantially no spacing between adjacent tubes. The dimensions and shapes of the gas discharge tubes 20R-28B shown in FIGS. 6A and 6B are not the actual dimensions and shapes, but they are drawn thicker and shorter with the arcing along the length direction drawn rather straight, for easy understanding of the disposition. In FIGS. 6A and 6B, signal electrodes A1, A2, . . . , Am formed on the rear support sheet 32 are placed in intimate contact with the rear surfaces of the curved thin gas discharge tubes 20R-28B, and pairs of transparent display electrodes X1 and Y1, X2 and Y2, . . . , Xn and Yn, formed on the transparent front support sheet 31 are placed in intimate contact with the front surfaces of the thin gas discharge tubes 20R-28B. R, G and B thin gas discharge tubes in each set of thin gas discharge tubes, 20R-28B, have the same length, but the thin gas discharge tubes 20R-28B at lower levels in the arrangement 10 are larger in length, and the thin gas discharge tubes 20R-28B at higher levels are smaller in length. For example, the number m of the thin elongated discharge tubes is m=3,000, and the number n of the electrode pairs is n=1,000.

Figure 7:
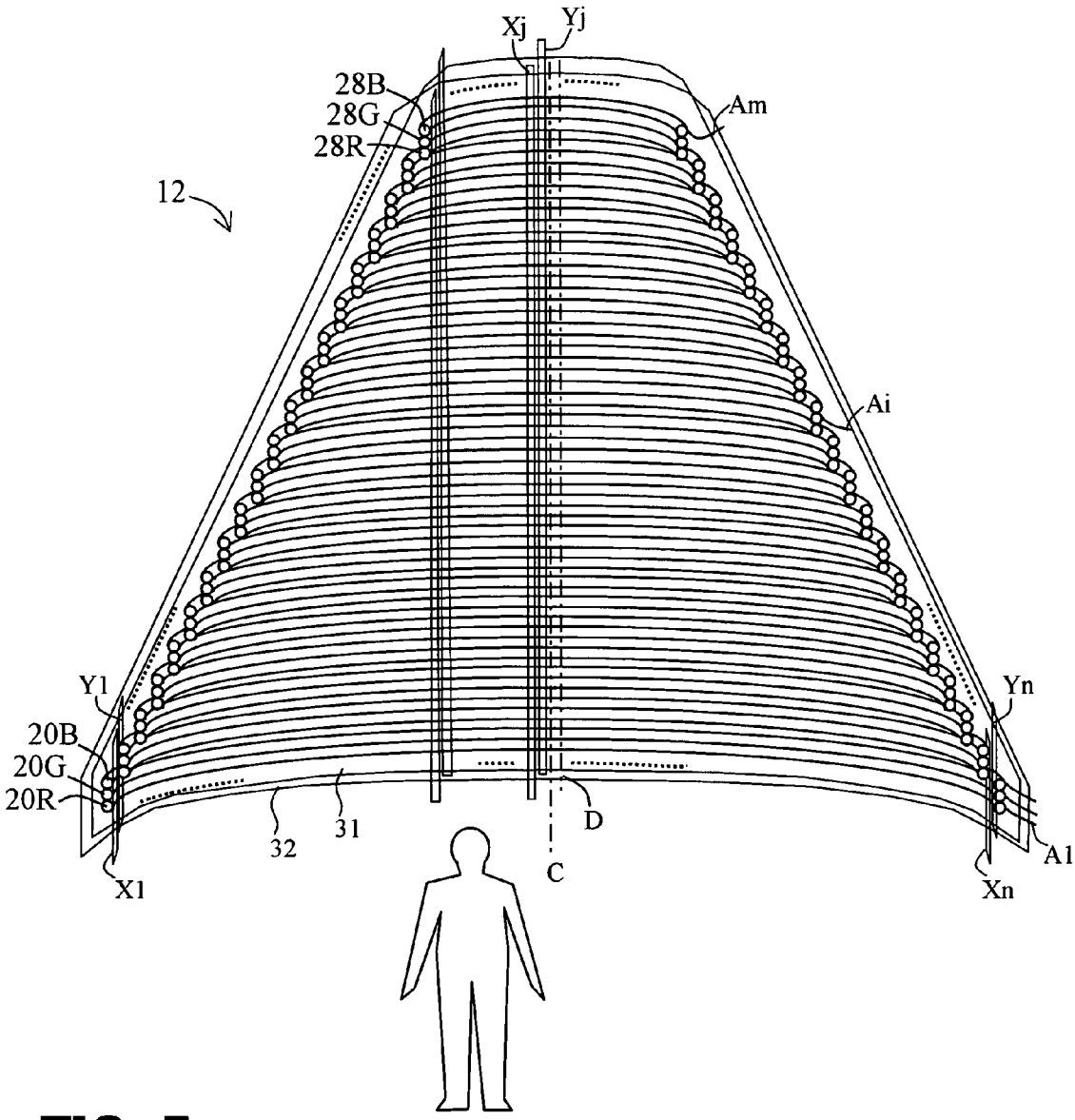
FIG. 7 is a perspective view of a display device in accordance with a first embodiment of the invention, in which the thin elongated gas discharge tubes sandwiched between the support sheets shown in FIGS. 6A and 6B, are curved so as to provide an inward facing display screen.

FIG. 7 is a perspective view of a display device 12 in accordance with a first embodiment of the invention, in which the thin elongated gas discharge tubes (20R, 20G, 20B), (21R, 21G, 21B), . . . , and (28R, 28G, 28B) sandwiched between the support sheets 31 and 32, shown in FIGS. 6A and 6B, are curved into an arcuate shape extending over an angle of about 180 degrees so as to provide an inward facing display screen. The display device 12 has generally a halved-cone shape. The gas discharge tubes 20R-28B of the display device 12 are curved into a semicircular shape, and are disposed generally coaxially about a vertical center axis C with the curving line of each tube along the length disposed in a horizontal plane. The gas discharge tubes 20R-28B are successively disposed in such a manner that longer tubes are at lower levels and shorter tubes are at higher levels, and that the tubes with larger radii being at lower levels and the tubes with smaller radii being at higher levels. In other words, the tubes are successively disposed in such a manner that tubes with smaller curvatures are at lower levels and tubes with larger curvatures are at higher levels. The gas discharge tubes 20R-28B are disposed adjacent to each other with substantially no gaps disposed between adjacent ones, at substantially regular intervals.

When the viewer is facing the display screen of the display device 12, standing at the location of the center axis C of the display device 12 with the above-described structure, the display device 12 can cover substantially the entire field of vision of the viewer, i.e. the areas in front of and above the viewer. The display device 12 may be formed of two, left and right parts abutting along a dividing line D, or may be formed of three or more parts abutting along two or more dividing lines. Alternatively, two or more such display devices 12 may be combined to provide a dome-shaped display screen, which can realize a display device providing a larger viewing angle.

Figure 8:
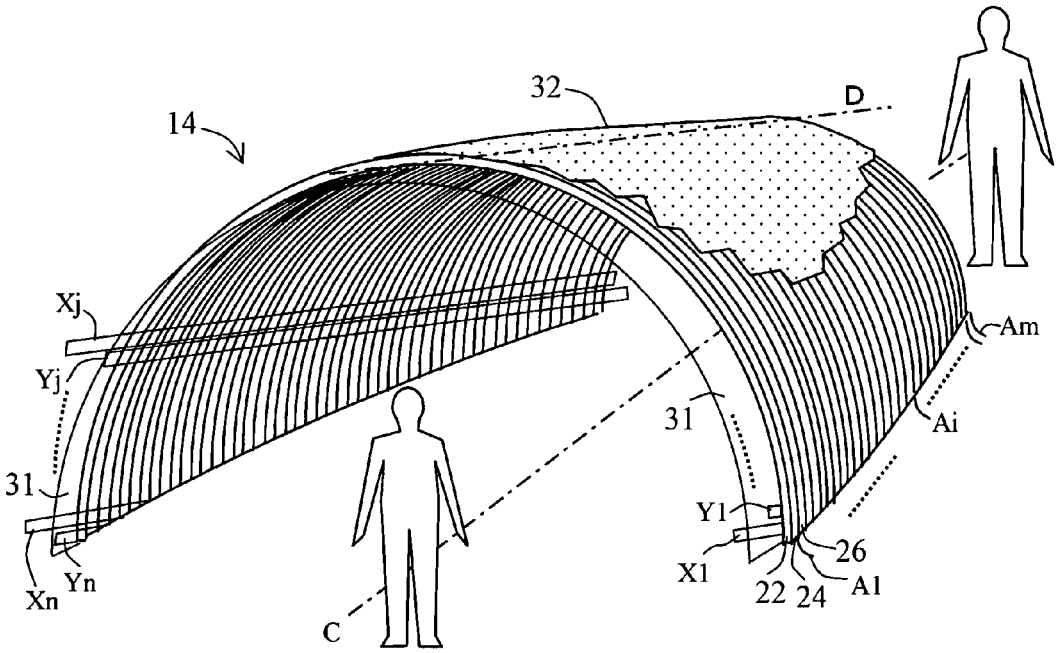
FIG. 8 is a perspective view of another display device in accordance with a second embodiment of the invention, in which the thin elongated gas discharge tubes sandwiched between the support sheets shown in FIGS. 6A and 6B are curved so as to provide an inward facing display screen.

FIG. 8 is a perspective view of another display device 14 in accordance with a second embodiment of the invention, in which the thin elongated gas discharge tubes (20R, 20G, 20B), (21R, 21G, 21B), . . . , and (28R, 28G, 28B) sandwiched between the support sheets 31 and 32, shown in FIGS. 6A and 6B, are curved in such a manner as to provide an inward facing display screen. The display device 14 is tunnel-shaped and is in the form of the display device 12 of FIG. 6 turned sideways. The gas discharge tubes 20R-28B of the display device 14 are curved into a semicircular shape with the curving line along the length disposed in a vertical plane. The tubes are disposed generally coaxially about a center axis C such that longer tubes are disposed nearer to the front and shorter tubes are disposed deeper into the display device 14, or, in other words, tubes with smaller curvatures are disposed nearer to the front and tubes with larger curvatures are disposed deeper into the display device 14. The gas discharge tubes 20R-28B are disposed adjacent to one another with substantially no gaps disposed between adjacent ones and at substantially regular intervals.

With this arrangement, when the viewer stands on the center axis C facing the deepest portion of the display screen of the display device 14, the display device 14 can cover substantially the entire field of vision of the viewer or, in other words, the regions in front of and above the viewer. The display device 14 may be formed of two, left and right parts abutting along the dividing line D, or formed of three or more parts abutting along two or more dividing lines. A transparent plate may be disposed as the floor of the display device 14 with another display device 14 disposed beneath the transparent floor, which can realize a display device providing a larger viewing angle.

The above-described embodiments are only typical examples, and their combination, modifications and variations are apparent to those skilled in the art. It should be noted that those skilled in the art can make various modifications to the above-described embodiments without departing from the principle of the invention and the accompanying claims.

What is claimed is:

1. A display device having a display screen, said display screen comprising a plurality of gas discharge tubes disposed side by side, each of said gas discharge tubes including a phosphor layer formed therein and also including a discharge gas contained therein, each gas discharge tube having a plurality of light-emitting points, each of said plurality of gas discharge tubes being curved along the longitudinal direction thereof, said display screen being formed by combining said plurality of gas discharge tubes having different magnitudes of curvature.

2. A display device having a display screen, said display screen comprising a plurality of gas discharge tubes disposed side by side, each of said gas discharge tubes including a phosphor layer formed therein and also including a discharge gas contained therein, each gas discharge tube having a plurality of light-emitting points, said display screen has a curving shape, each of said plurality of gas discharge tubes being curved along the longitudinal direction thereof, said plurality of gas discharge tubes being disposed side by side in such a manner that the magnitude of curvature of said display screen decreases from one side to the other.

3. A display device according to claim 2, wherein said display screen is arranged in such a manner that the longitudinal direction of said plurality of gas discharge tubes is the lateral direction of said display screen, said plurality of gas discharge tubes being arranged side by side in such a manner that the magnitude of curvature of said display screen decreases from the top side toward bottom side of said display screen.

4. A display device according to claim 2, wherein said display screen is formed to have a shape of tunnel, said plurality of gas discharge tubes being disposed side by side in such a manner that the longitudinal directions of said respective gas discharge tubes extend about the center axis of said tunnel, and that the magnitude of curvature of said display screen decreases from the deep end side toward front end side of said display screen.

* * * * *